US005735127A

United States Patent [19]

Pfotenhauer et al.

[11] Patent Number: 5,735,127

[45] Date of Patent: Apr. 7, 1998

[54] CRYOGENIC COOLING APPARATUS WITH VOLTAGE ISOLATION

[75] Inventors: John M. Pfotenhauer, Madison; Orrin D. Lokken, Fitchburg, both of Wis.

[73] Assignee: Wisconsin Alumni Research Foundation, Madison, Wis.

[21] Appl. No.: 495,969

[22] Filed: Jun. 28, 1995

[51] Int. Cl.[6] ..... F25B 9/00

[52] U.S. Cl. ..... 62/6; 62/51.1; 62/259.2; 165/4; 174/125.1; 335/216

[58] Field of Search ..... 62/6, 55.5, 51.1, 62/259.2; 165/4, 10; 174/125.1; 335/216

[56] References Cited

U.S. PATENT DOCUMENTS

| | | | |
|---|---|---|---|
| 1,275,507 | 8/1918 | Vuilleumier . | |
| 2,657,553 | 11/1953 | Jonkers . | |
| 2,906,101 | 9/1959 | McMahon et al. . | |
| 2,966,035 | 12/1960 | Gifford . | |
| 3,237,421 | 3/1966 | Gifford . | |
| 3,312,072 | 4/1967 | Gifford . | |
| 3,314,244 | 4/1967 | Green . | |
| 3,339,627 | 9/1967 | Van Geus et al. | 165/4 |
| 3,431,746 | 3/1969 | Webster et al. . | |
| 3,673,809 | 7/1972 | Bamberg . | |
| 3,692,095 | 9/1972 | Fleming | 165/4 |
| 3,817,044 | 6/1974 | Daniels . | |
| 3,902,328 | 9/1975 | Claudet . | |
| 3,960,204 | 6/1976 | Horn | 165/4 |
| 4,122,512 | 10/1978 | Peterson et al. . | |
| 4,143,520 | 3/1979 | Zimmerman | 62/6 |
| 4,231,231 | 11/1980 | Lawless | 62/6 |
| 4,354,355 | 10/1982 | Lawless | 62/6 |
| 4,359,872 | 11/1982 | Goldowsky | 62/6 |
| 4,403,478 | 9/1983 | Robbins | 62/6 |
| 4,404,808 | 9/1983 | Andeen | 62/6 |
| 4,475,346 | 10/1984 | Young et al. | 62/6 |
| 4,490,983 | 1/1985 | Gifford et al. . | |
| 4,574,591 | 3/1986 | Bertsch | 62/6 |
| 4,606,194 | 8/1986 | Pirtle et al. | 62/6 |
| 4,622,531 | 11/1986 | Eyssa et al. . | |
| 4,708,725 | 11/1987 | Okumura . | |
| 4,735,053 | 4/1988 | Carpetis . | |
| 4,835,973 | 6/1989 | Jones et al. | 62/6 |

(List continued on next page.)

OTHER PUBLICATIONS

R.C. Niemann, et al., "Low-Thermal-Resistance, High-Electrical-Isolation Heat Intercept Connection," in Advances in Cryogenic Engineering, vol. 39, P. Kittel, ed., Plenum Press, NY (1994), pp. 1665–1673.

(List continued on next page.)

*Primary Examiner*—Ronald C. Capossela
*Attorney, Agent, or Firm*—Foley & Lardner

[57] ABSTRACT

A cryogenic cooling apparatus (cryocooler) with voltage isolation includes a cold end structure, which may be placed in thermally and electrically conductive contact with an electrically charged structured to be cooled, a warm end, and an electrically insulating structure between the warm end and the cold end structure of the apparatus so as to electrically isolate the cold end structure from the warm end. Two cold fingers, each comprising a cold end structure, a warm end, and the insulating structure, may be conveniently combined into a single cooling apparatus for the cooling of two electrically charged structures at different voltage levels, e.g., conductive electrical leads to a cryogenic superconductive energy storage device. The electrically insulating structure is selected so as to provide both electrical isolation and to contain a cryogenic working fluid within the cold finger of the cryocooler. The cryogenic working fluid in the cold finger may be cooled by the use of a variety of thermodynamic cycle methods, including the Gifford-McMahon cycle, and a pulse-tube type cycle. For a Gifford-McMahon type cryocooler, the electrically conductive regenerator material located in a cold finger regenerator is interleaved with electrically insulating separators so that the local electric potential in the working fluid remains less than the breakdown voltage of the fluid as defined by Paschen's curve. The cold fingers may form the single stage of a cryogenic cooler or the terminal stages of a multi-stage cryogenic cooler.

50 Claims, 5 Drawing Sheets

U.S. PATENT DOCUMENTS

| | | | |
|---|---|---|---|
| 4,848,092 | 7/1989 | Gifford . | |
| 4,872,321 | 10/1989 | Buchanan . | |
| 4,901,787 | 2/1990 | Zornes | 62/6 |
| 4,953,366 | 9/1990 | Swift et al. . | |
| 5,010,737 | 4/1991 | Okumura et al. . | |
| 5,090,206 | 2/1992 | Strasser . | |
| 5,103,647 | 4/1992 | Ackermann . | |
| 5,107,683 | 4/1992 | Chan et al. | 62/6 |
| 5,111,665 | 5/1992 | Ackermann | 62/6 |
| 5,113,663 | 5/1992 | Gifford . | |
| 5,152,147 | 10/1992 | Saho et al. | 165/4 |
| 5,237,298 | 8/1993 | Boom et al. . | |
| 5,269,147 | 12/1993 | Ishizaki et al. . | |
| 5,275,002 | 1/1994 | Inoue et al. . | |
| 5,295,355 | 3/1994 | Zhou et al. . | |
| 5,303,555 | 4/1994 | Chrysler et al. . | |
| 5,315,277 | 5/1994 | Eyssa et al. . | |
| 5,335,505 | 8/1994 | Ohtani et al. . | |
| 5,381,666 | 1/1995 | Saho | 62/51.1 |
| 5,447,034 | 9/1995 | Kuriyama et al. | 165/4 |
| 5,495,718 | 3/1996 | Pierce et al. | 62/51.1 |

OTHER PUBLICATIONS

M.A. Daugherty, et al., "HTS Current Lead Using a Composite Heat Pipe," IEEE Trans. on Applied Superconductivity, vol. 5, No. 2, Jun., 1995, pp. 773–776.

G. Walker, Miniature Refrigerators for Cryogenic Sensors and Cold Electronics, Clarendon Press, 1989, pp. 74–76.

C. DeWinkel, et al., "Strong power for critical loads", IEEE Spectrum, Jun., 1993, pp. 38–42.

Cryomech, Advertisement Literature, no date.

Cryomech, Data Sheet, Model AL10 Cryorefrigerator, no date.

Cryomech, Data Sheet, Model AL25 Cryorefrigerator, no date.

Cryomech, Data Sheet, Model AL60 Cryorefrigerator, no date.

Cryomech, Data Sheet, Model AL200 Cryorefrigerator, no date.

Cryomech, Data Sheet, Model GB15 Cryorefrigerator, no date.

Cryomech, Data Sheet, Model GB220 Cryorefrigerator, no date.

Cryomech, Data Sheet, Model GB04 Cryorefrigerator, no date.

Cryomech, Data Sheet, Model GB37 Cryorefrigerator, no date.

Paschen curves for various gases

CRYOGENIC COOLING APPARATUS WITH VOLTAGE ISOLATION

This invention was made with United States Government support awarded by DNA, Grant No. SAIC subcontract No. 04-940166-81 of SAIC prime contract No. FO4606-89-D068. The United States Government has certain rights in this invention.

FIELD OF THE INVENTION

This invention pertains generally to the field of cryogenic refrigeration and particularly to the cryogenic cooling of electrically charged structures.

BACKGROUND OF THE INVENTION

Cryogenic refrigerators which can obtain temperatures of below 10 K are well known in the prior art. These cryogenic refrigerators typically employ thermodynamic cycles which involve the compression, cooling, expansion, and reheating of a working fluid, such as helium gas. The cooled working fluid is used to draw heat from a portion of the refrigerator. The thermodynamic cycles typically employed include the Vuilleumier cycle (See, e.g., U.S. Pat. No. 1,275,507), the Stirling cycle (See, e.g., U.S. Pat. Nos. 2,657,553 and 3,312,072), the Gifford-McMahon cycle (See, e.g., U.S. Pat. No. 2,906,101), the pulse-tube type cycle (See e.g., U.S. Pat. No. 3,237,421), and others. Such cryogenic refrigerators may involve one, two, or multiple refrigeration stages. For example, U.S. Pat. No. 5,113,663 describes a multistage cryogenic refrigerator utilizing the Gifford-McMahon refrigeration cycle. Moreover, different types of thermodynamic refrigeration cycles may be combined in a single cryogenic refrigerator. For example, U.S. Pat. No. 3,902,328 describes a cryogenic refrigerator using both a continuous circulation fluid cycle and an alternate circulation fluid cycle. For each thermodynamic cycle employed many refrigerator designs have been developed. For example, designs for cryocoolers operating in accordance with the Gifford-McMahon Cycle are shown, e.g., in U.S. Pat. Nos. 2,906,101, 2,966,035, 3,673,809, 4,490,983, 4,708,725, 4,735,053, 4,848,092, 4,872,371, 5,010,737, 5,090,206, 5,103,647, and 5,113,663.

In one application, cryogenic refrigerators are used for draining heat from a localized structure within a cryogenically cooled device. A cryogenic refrigerator employed in such a manner may be referred to as a cryogenic cooler, or cryocooler. Cryocoolers may be employed, for example, to drain away the heat introduced into a cryogenically cooled magnetic storage device via the electrical conductive leads that link the cryogenic interior of the device with the normal room temperature of the outside environment. Cooling of the localized structure is performed by connecting the cryocooler to the structure to be cooled, in this case at an intermediate point along the conductive leads which are inside the cryogenic device, via a good thermally conducting connection. The thermally conducting part of the cryocooler which extends in contact with the localized structure to be cooled may be known by a variety of names, including the cold end, cold head, or cold finger.

The use of a cryocooler for the purpose described above illustrates a general problem in the use of cryocoolers to cool electrically charged structures. Because the electrical conductive leads entering the magnetic storage device are electrically charged, it is necessary to electrically insulate them from the parts of the cryocooler—which is typically made entirely of a conducting material such as stainless steel—that might come into electrical contact with outside structures. One solution to this problem is to place an electrically insulating material between the cryocooler's cold finger and the electrically charged structure. However, this method of providing voltage isolation is not particularly effective, as electrically insulating materials tend also to be thermally insulating. Thus, electrical isolation is achieved at the cost of cooling effectiveness.

SUMMARY OF THE INVENTION

In accordance with the present invention a cryogenic refrigerator or cryocooler is provided having a cold end structure, e.g., at the end of a cold finger, which may be placed in intimate thermal and electrical contact with an electrically charged structure while the rest of the cryocooler is electrically isolated from the charged structure. This electrical isolation is achieved by both interrupting electrical conductivity from the cold end structure through the physical structure of the cryocooler cold finger and by preventing voltage breakdown of a working fluid in a chamber formed by the cold finger structure. A cryocooler in accordance with the present invention may have multiple cold fingers, which may be used to conductively cool respective multiple surfaces which are at different voltage potentials.

A cryocooler in accordance with the present invention conductively cools an electrically charged structure by removing thermal energy from the structure by conduction through a structure made of a thermal conductor, such as copper, at the cold end of the cryocooler's cold finger. The thermal energy is transferred from the cold end to the warm end of the cold finger by a working fluid, such as helium gas in the cold finger chamber. The solid structure of the cryocooler between the cold end of the cold finger and the warm end of the cold finger includes electrically insulating enclosing walls which form the cold finger chamber and provide the necessary voltage isolation between the cold end and the warm end of the cold finger. During operation of the cryocooler the working fluid is contained in the cold finger chamber. Electrically insulating separator members are used in such cases to divide a regenerator material contained in the cold finger chamber, providing voltage steps to insure that the local electric field in the cryocooler working fluid never exceeds, by some suitable margin, the breakdown voltage of the working fluid, as defined by Paschen's curve. Such a breakdown could cause arching to occur within the fluid, and electrical separation of the cold end and the warm end of the cryocooler could be compromised.

The necessary voltage isolation is accomplished in the first case by forming a portion of the outer enclosing wall of the cryocooler cold finger of a mechanically strong insulating material, such as a ceramic, so that the differential pressure from the inside to the outside of the cryocooler is contained, the thermal conduction along this wall is minimized, and the desired electrical insulation is achieved. In the case where there is a regenerator in the chamber containing the cryocooler working fluid the regenerator preferably includes electrically insulating separators which allow flow of the working fluid through them. These separator pieces, for example, formed as G-10 Fiberglass epoxy screens, are of sufficient number and thickness so that the total voltage potential across the working fluid will be distributed in many small voltage steps. Each of the small voltage steps must be less, by a suitable margin, than the breakdown voltage in the working fluid at its lowest pressure. Finally, any additional structure inside the cryocooler, for example the moving structure of a displacer, or the enclosure of a regenerator, should also be constructed of electrically insulating material to maintain the same electrical isolation.

A single cryocooler in accordance with the present invention may be used to conductively cool multiple surfaces which are at different voltage potentials. For example, a single cryocooler may be used to cool both of the electrical leads linking the cryogenic (very low temperature) interior of a superconductive energy storage device to an electrical power source or load. This can be accomplished by a cryocooler having two cold fingers, each having separate cold end structures conductively connected to each of the two electrically charged structures. The electrically insulating structures of the cold fingers are then located between the conducting cold end structures of the cold fingers and the warm end of the cryocooler where the two cold fingers are joined together.

The dual cold finger cryocooler in accordance with the present invention just described may be a one stage, two stage, or multiple stage cryocooler. Cryocoolers having two or more stages are able to achieve lower temperatures than single stage cryocoolers. For a two or more stage cryocooler the electrically insulating structures are placed between the conducting cold end structures of the cold fingers, which comprise the last stage of the cryocooler, and the warm ends of the cold fingers, where the cold fingers are connected to a previous stage of the cryocooler. In this way multiple cold fingers, acting as the terminal stages of the cryocooler, may share the same previous stages of the cryocooler while maintaining electrical isolation from each other and from the previous stages. A single or multiple stage cryocooler having a single cold finger may also employ the voltage isolation characteristics of the present invention.

The present invention may be applied to cryocoolers employing a variety of alternate circulation type thermodynamic cycles, including the Gifford-McMahon cycle, the pulse-tube type cycled the Stirling cycle, or the Vuilleumier cycle. The present invention may also be applied to cryocoolers employing continuous circulation type thermodynamic cycles such as the Claude cycle, and the Brayton cycle. The present invention may also be applied to cryocoolers with multiple stages employing a combination of continuous circulation and alternate circulation type cycles.

Further objects, features, and advantages of the present invention will be apparent from the following detailed description when taken in conjunction with the accompanying drawings.

DETAILED DESCRIPTION OF THE INVENTION

Figure 1:
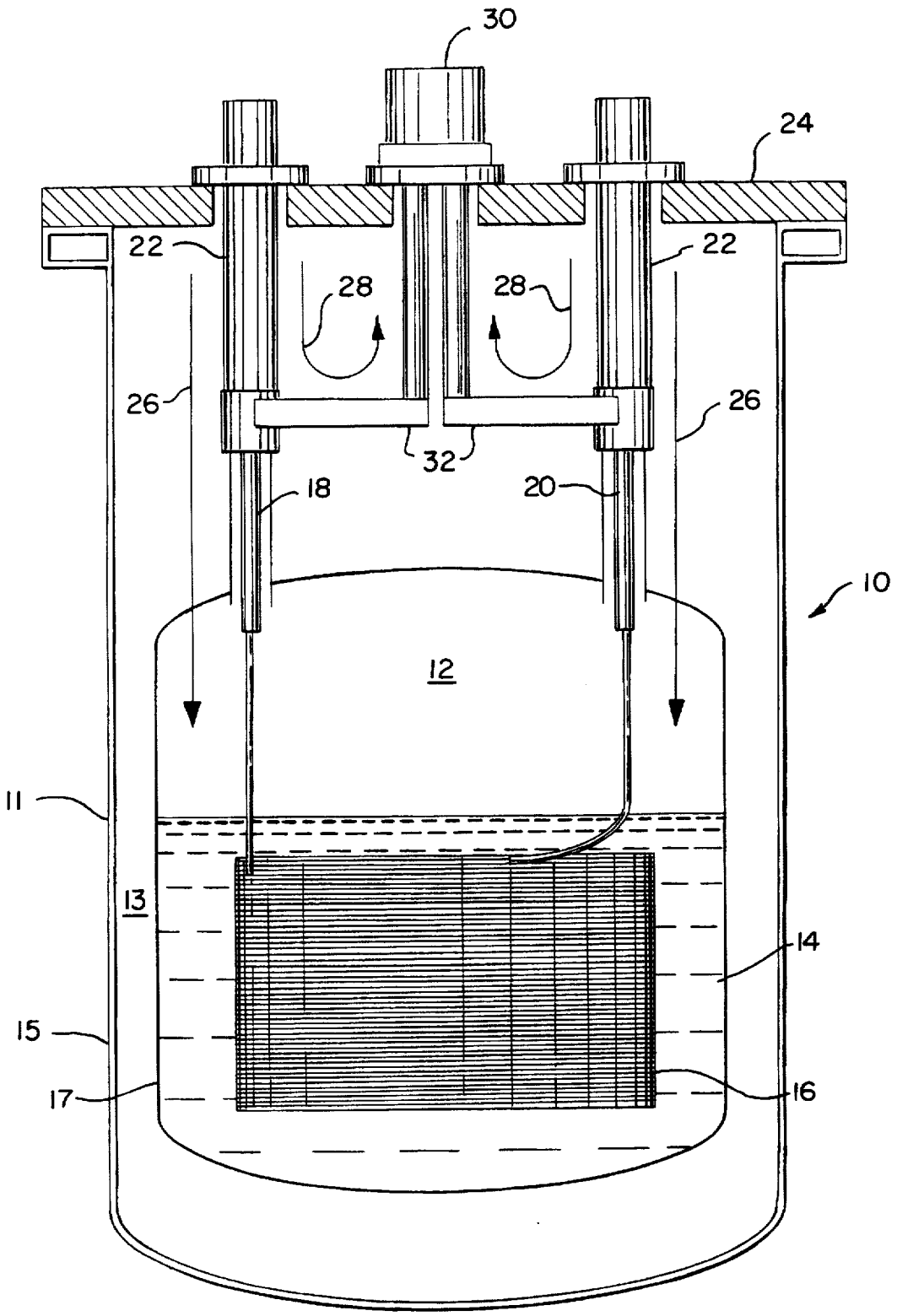
FIG. 1 is a simplified cross-sectional view of a cryogenically cooled device employing a cryocooler in accordance with the present invention to cool the electrical conductive leads that link the cryogenic interior of the device to the outside environment.

An exemplary application of a cryocooler in accordance with the present invention is shown with reference to FIG. 1. A cryogenically cooled device is shown generally at 10. A thermally insulated cryostat vessel (e.g., a dewar) forms the enclosure 11 which separates the interior 12 of the device from the outside environment. A vacuum space 13 separates an outer wall 15 of the vessel 11 from an inner vessel wall 17. The interior 12 of the cryogenically cooled device 10 is cooled to cryogenic temperature levels by, for example, the circulation of a cryogenically cooled fluid 14, such as liquid helium, into the interior 12 of the device 10. Located within the device 10 is a structure 16, such as a superconducting magnet used to store back-up electrical energy (the magnetic field produced by current in a super-conducting coil stores the energy), which is cooled to cryogenic temperature levels by the cooling fluid 14. Such superconductive energy storage devices are described, for example, in U.S. Pat. Nos. 4,122,512, 4,622,531, 5,237,298, and 5,315,277, incorporated by reference. The structure 16 is provided with electrical power through conductive leads 18 and 20 which connect the device 16, which is inside the cryogenically cooled unit 10, to an electrical power source or load (not shown), which is removed from the cryogenically cooled unit 10 and which will typically be at room temperature. At the core of the leads 18 and 20 is an electrically conductive material, such as copper, which is also typically highly thermally conductive. Thus, heat will tend to be introduced into the interior 12 of the device 10 from the outside environment via the leads 18 and 20 themselves. This flow of heat into the device 10 is indicated by the arrows 26. Heat will also be resistively generated by the flow of current through the leads 18 and 20. A section 22 of the leads 18 and 20 is designed so that boil-off gas from the cooling fluid 14, resulting from the heat conducted and generated by the leads 18 and 20, will flow up through the leads 18 and 20, thereby absorbing some of the heat along with the gas flow. Optimized leads 18 and 20 are designed so that when current is flowing in the leads 18 and 20, the warm ends of the leads 18 and 20 and the exiting gas will be very near room temperature.

A dual cold finger cryocooler 30 in accordance with the present invention may be used to cool the leads 18 and 20 by drawing off the incoming heat from the leads 18 and 20 which would otherwise be conducted into the interior 12 of the device 10. This effect is shown by the arrows 28, indicating a flow of heat from the leads 18 and 20 into the cryocooler 30. To more effectively draw heat from the leads 18 and 20, the cryocooler 30 is connected to the leads 18 and 20 via highly thermally conducting connections 32. Good thermal conductors, however, are also good electrical conductors. As can been seen, therefore, the cryocooler 30 can create an undesirable electrical connection between the leads 18 and 20 unless part of the cryocooler 30 structure is made of insulating material so as to maintain the voltage separation of the leads 18 and 20. A similar problem would arise if a single cold finger cryocooler were used to drain heat from a single electrically charged structure, or two separate such cryocoolers were used to drain heat from two separately charged structures such as the conducting leads 18 and 20. In either case, the entire cryocooler 30, which is typically made of an electrically conducting material such as stainless steel, would become charged to the voltage level of the lead to which it was attached. Short circuiting would likely result from the connection of the cryocooler 30 with the top wall 24 of the device 10, or with other structures outside of the unit 10. Electrical isolation of the part of the cryocooler 30 which is external to the unit 10 could be difficult, and, in any case, it is not desirable, for safety reasons, to have an exposed and electrically charged structure, such as the cryocooler 30, outside of the unit 10. In the present invention, the cold fingers of the cryocooler 30 are provided with electrically insulating structures which electrically isolate the cold end of the cryocooler 30 from the warm end, while permitting the use of thermally and electrically conducting connections 32 at the cold end.

The structure shown in FIG. 1 is only an exemplary application of the cryocooler of the present invention. It is understood that the present invention may be applied wherever cooling of an electrically charged structure, while maintaining electrical isolation of that structure, is required.

Figure 2:
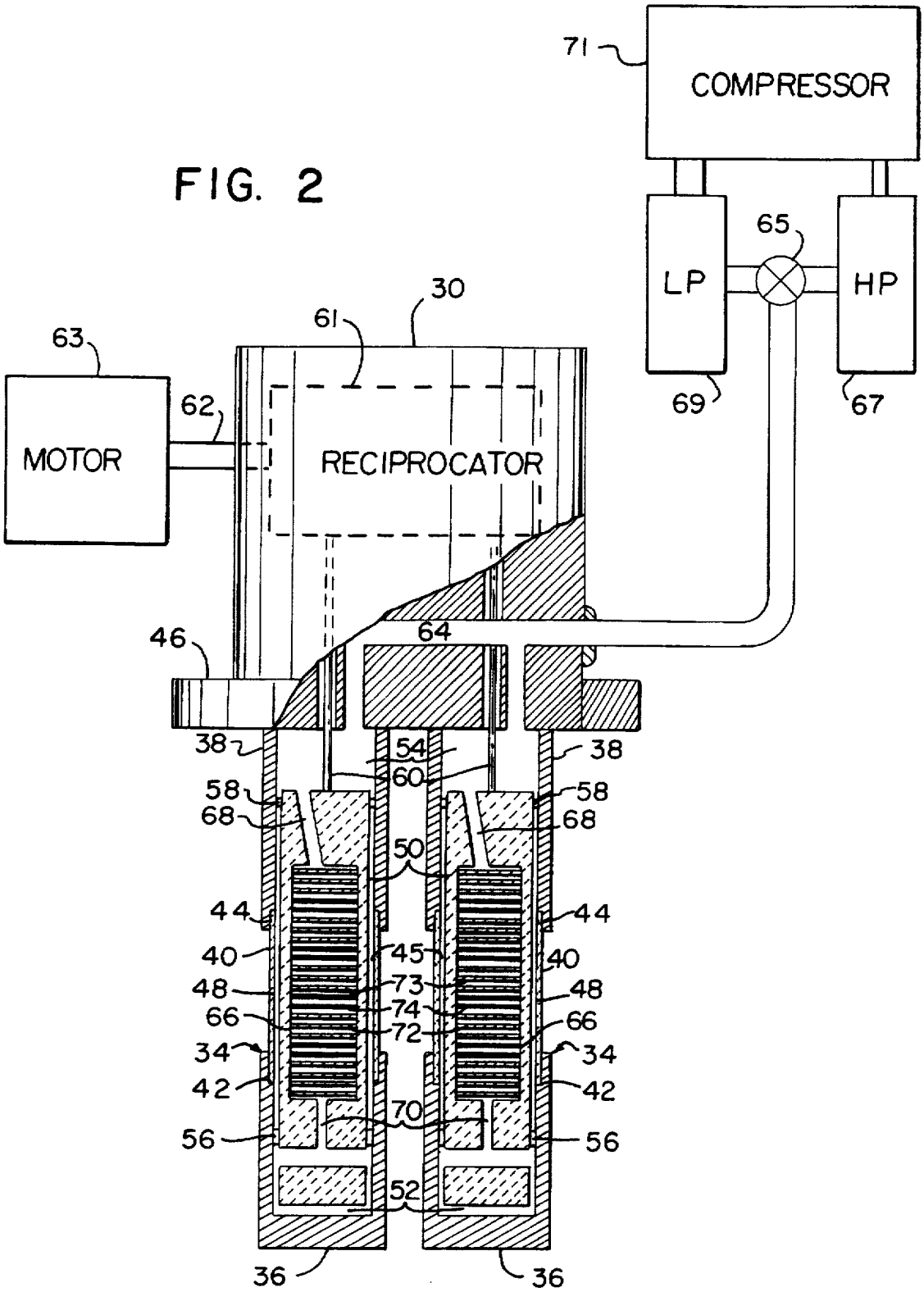
FIG. 2 is a simplified view in partial cross-section of a single stage dual cold finger cryocooler in accordance with the present invention.

A dual cold finger, single stage cryocooler 30, in accordance with the present invention is described with reference to the partial cross-sectional view of FIG. 2. A cryocooler with a single cold finger may also be formed in accordance with the present invention, however, the dual cold finger structure is particularly useful for the cooling of electrical leads which are at different voltage levels. Each of the cylindrically shaped cold fingers 34 is essentially identical to the other and, therefore, identical parts in each cold finger are identically labelled in the drawing. The bottom 36, or cold end, of each cold finger 34 is preferably a caps plate, or other structure made of a highly thermally conducting material, such as copper. It is this cold end structure 36 which is connected to the electrically charged structure (not shown in FIG. 2) which is to be cooled. At the other end of each cold finger 34 is a warm end structure 38 which may also be of a conducting material, such as stainless steel. Between the warm end 38 and cold end 36 of each cold finger 34 an electrically insulating material is used to form a portion of the enclosing wall 40 of the cold finger 34. The insulating wall 40 is preferably connected between the cold end 36 and the warm end 38 by inserting the ends of the wall 40 into seats 42 and 44 in the cold end 36 and warm end 38 structures, respectively. The joints between the insulating wall 40 and warm end 38 and cold end 36 structures must be able to withstand repeated thermal cycling between room temperature and cryogenic temperatures. Brazed joints between, for example, stainless steel ends 36 and 38 and a ceramic wall 40 can be used for this purpose. The cold end structure 36, warm end structure 38, and insulating wall 40 form an essentially cylindrically shaped outer structure of the cold finger 34 and enclose a chamber 45 in which a working fluid is contained during operation of the cryocooler 30. The two cold fingers 34 are joined together at a pressure head 46 forming, in part, a flange whereby the cryocooler 30 may be attached to the wall 24 of a vacuum vessel 11 as shown in FIG. 1.

The insulating enclosing walls 40 must be made of a material which is both electrically insulating and strong enough to accommodate a pressure differential between the inside and outside of the cold finger 34. This pressure differential, as will be described in more detail below, is the result of the introduction of a pressurized working fluid into the interior chamber 45 of the cold finger. The highest pressure differential between the outside and inside of the cold finger 34 which can typically be expected is approximately 25 atmospheres. Additionally, the material selected for the enclosing wall 40 must not allow diffusion of the working fluid from the chamber 45 through the wall 40 to the outside of the cold finger 34. A preferable material for use as the insulating wall 40 is a ceramic, such as low purity alumina ceramic ($Al_2O_3$) with silicon impurities, although other materials; such as epoxy-fiberglass composites (e.g., G-10), may also be used. An exemplary supplier of suitable ceramic materials is Ceramic to Metal Seals, Inc., Syracuse, N.Y. Diffusion is prevented by making the insulating walls 40 sufficiently thick. If the wall 40 is made of an epoxy fiberglass, the thickness of the wall will not have a significant influence on limiting gas diffusion. In such a case, an internal sleeve (not shown) of a material such as stainless steel may be added to the inner surface 48 of the insulating wall 40, as a diffusion barrier. If an electrically conducting diffusion barrier is used, however, it must be so placed as to not create an electrical connection between the cold end 36 and the warm end 38 structures of the cold finger 34. For example, a small gap may be placed in the diffusion barrier to prevent electrical conduction across the barrier without greatly reducing the effectiveness of the barrier. Finally, the insulated enclosing wall 40 must be sufficiently long and thin to minimize heat transfer through the wall from the warm end 38 to the cold end 36 of the cold finger.

Preferably a displacer cylinder 50 is coaxially aligned in the chamber 45 of each cold finger 34. The displacer 50 is configured to move up and down (in a reciprocating motion) inside of the chamber 45. The displacer 50 is also made of an electrically insulating material, and may be made of a material such as micarta or phenolic. The displacer defines two chamber sections on the inside chamber 45 of the cold finger 34, a cold end chamber section 52 and a warm end chamber section 54. The bottom and top edges of the displacer 50 are sealed at 56 and 58, respectively, to the inner surface 48 of the cold finger wall 40 so that working fluid may not travel from one chamber section 52 to the other 54 between the wall 40 and the displacer 50. The seal 56 at the cold end of the displacer may be a very imperfect seal, serving more the purpose of an alignment ring. The displacer 50 is a loose fit inside of the cold finger chamber 45 except where equipped with the dynamic (sliding) seals 56 and 58, which allow for the reciprocating motion of the displacer 50. A drive rod 60 is supported on the top of the displacer 50. The drive rod 60 is connected through the pressure head 46 to a reciprocator mechanism 61. The drive rod 60 is slidingly sealed where it passes through pressure head 46. The reciprocator 61 drives the drive rods 60, and the displacers 50 to which they are attached, in a reciprocating manner. The reciprocator mechanism 61 may be implemented in a variety of ways well known in the art. For example, a fly wheel or cam connected by a suitable mechanical link 62 to a motor 63 may be used to reciprocate the drive rods 60. Alternatively, the reciprocator mechanism 61 may employ pressurized fluid to pneumatically reciprocate the drive rods 60.

The warm end chamber section 54 is connected by a passageway 64 to a valve 65. The valve acts to alternately admit high and low pressure working fluid from high pressure 67 and low pressure 69 sources, which are preferably remote from the cryocooler 30 itself. Of course the single valve 65 may be replaced by separate valves connecting each source 67 and 69 alternately to separate passageways into the warm end chamber 54. The high pressure working fluid may preferably be supplied by a refrigerant compressor unit 71 which may contain a cooler, for removing any heat of compression produced by the compressor, and a cleaner to clean the working fluid of any contamination, such as by compressor lubricant, which may occur during the compression process.

A regenerator 66, or heat accumulator, is enclosed in the displacer 50. The regenerator is used for storage of heat and, in operation, will achieve a temperature gradient whereby the regenerator will be at the ambient temperature of the warm end section chamber 54 at one end and will be at the ambient temperature of the cold end section chamber 52 at the other end, itself having an ambient temperature somewhere between these two extremes. The regenerator 66 includes a regenerator chamber 73 which is connected in fluid communication with the warm end chamber section 54 through a passageway 68 in the displacer 50, and with the cold end chamber section 52 through a second passageway 70 in the displacer. The regenerator chamber 73 is packed with porous thermally conducting material such that working fluid may pass from the warm end chamber 54 to the cold end chamber 52, and vice versa, through the regenerator chamber 73 and across the material packed therein. In this case, the displacer walls act as an enclosure forming the regenerator chamber 73 in which the material is enclosed.

In other embodiments, the regenerator may be fixed in the cold finger chamber 45. In such a case, the enclosing walls 40 may form part of the regenerator enclosing structure, with ends of the structure having passageways between the regenerator chamber 73 and cold finger chamber 45. Alternatively, the regenerator 66 may have an entirely independent enclosing structure enclosing the regenerator chamber 73. In any case, for any regenerator 66 located in the cold finger chamber 45, the enclosing structure of the regenerator must be of electrically insulating material.

Figure 3:
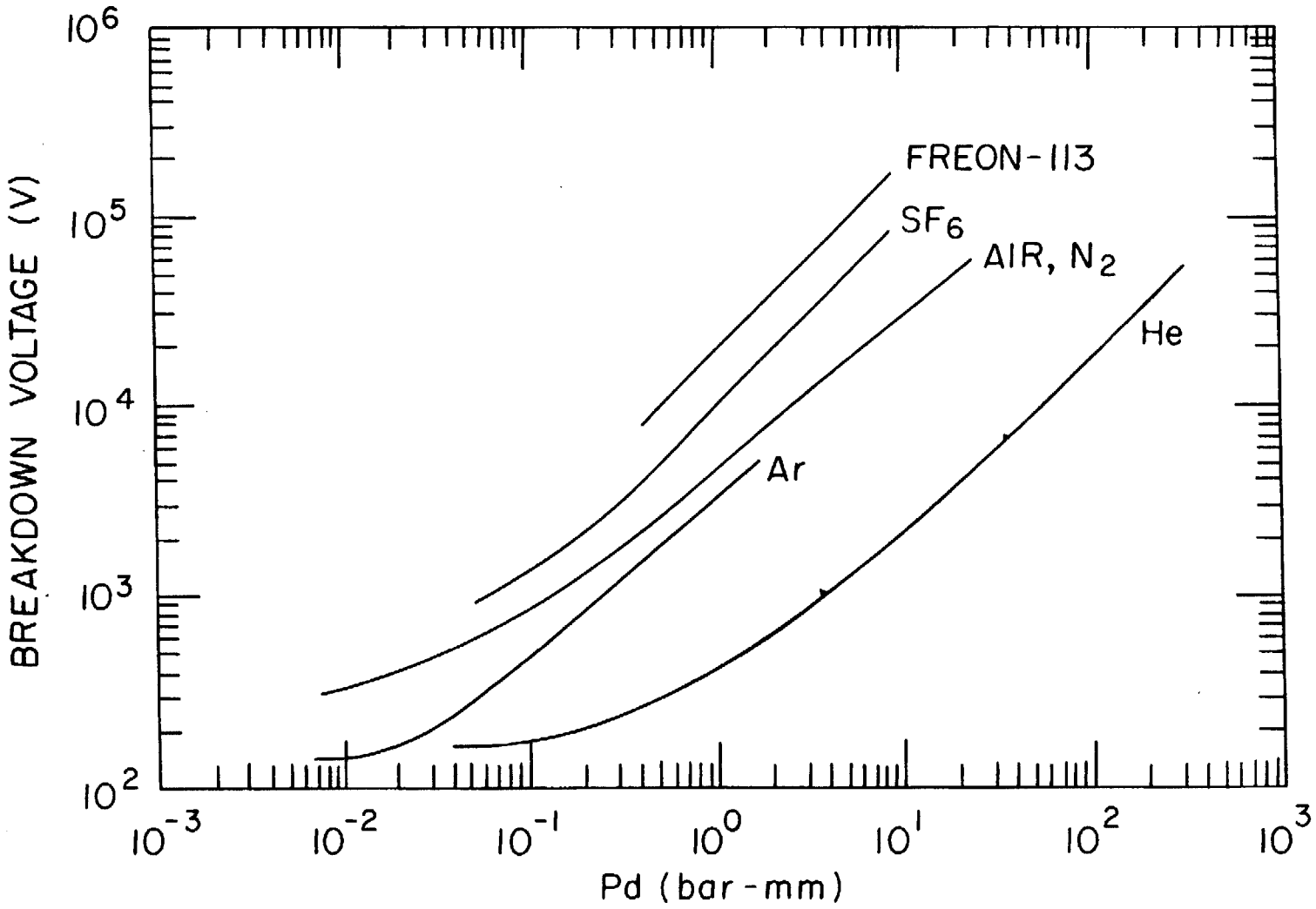
FIG. 3 is a plot of the Paschen curves for various gasses showing breakdown voltage versus the product of gas pressure and the separation distance between two surfaces of different electrical potential.

Typically, the regenerator material used will consist of stacked copper or bronze screens 72 or perforated disks of a high heat capacity metal which permit fluid flow. Interleaved between the screens of electrically conducting material 72 in the regenerator chamber 73 are separator screens of a non-conducting material 74, such as G-10, nylon, or polytetrafluoroethylene (Teflon®). These insulating screens 74 are necessary to provide voltage isolation between the cold end 36 and the warm end 38 through the working fluid. The alternating conducting screens 72 and non-conducting separator screens 74 divide the regenerator chamber 73 into subchambers to create a staged electrical potential drop in the working fluid stream inside the cold finger chamber 45 from the cold end 36, which will be connected to an electrically charged structure, to the warm end 38, which will typically be grounded. Therefore, the voltage drop between any two points in the working fluid will be relatively small. The working fluid, preferably inert helium gas, will typically not be electrically conducting. If the voltage across the working fluid at any one point were too large, however, voltage breakdown could occur, resulting in arcing within the working fluid. Electrical separation of the cold end 36 from the warm end 38 could, therefore, be compromised. The breakdown voltage versus the product of gas pressure and the separation distance between two surfaces of different electrical potential, known as Paschen's curves, for various gasses which may be used as working fluids for the cryocooler of the present invention are shown in FIG. 3. A sufficient number of insulating separator screens 74 must be placed in the regenerator in order to ensure that the local electric field inside of the cold finger 34 never exceeds, by some suitable margin, the breakdown voltage of the working fluid at its lowest expected pressure level as determined from the Paschen curve for the fluid used. Preferably, a safety factor of at least 2–2.5 times more voltage insulation than the minimum defined by Paschen's curve should be employed in order to avoid flash-over caused by voltage creep. Thus, for a given product of pressure times separation distanced the allowable voltage would preferably be smaller by a factor of approximately 2.5 than that defined by Paschen's curve. Alternatively, if a certain level of voltage isolation is desired, preferably a value of approximately 2.5 times the desired voltage level should be used to determine a safe value of pressure times separation distance from Paschen's curve. As has been shown, voltage isolation of the cold end 36 and warm end 38 of the cryocooler 30 requires electrical insulation of the structure of the cold finger 34 and insulating members which prevent arching of the working fluid in a regenerator 66 on the inside of the cold finger chamber 45.

The cryocooler 30 of the present invention shown in FIG. 2 operates using the Gifford-McMahon thermodynamic cycle to act on the working fluid as follows. With the displacer 50 at the bottom of the cold finger chamber 45, and adjacent to the bottom of the cold end 36, the valve 65 is opened to admit a working fluid under high pressure at room temperature through the passage 64 into the cold finger chamber 45. A preferred working fluid is helium gas, although other fluids may also be used depending on the temperature ranges required and the function of the system. The fluid fills the regenerator chamber 73 and the warm end chamber section 54 above the displacer 50. With the high pressure level maintained, the displacer 50 is moved from the bottom of the cold finger chamber 45 to the top by operation of the piston 60 and reciprocator 61o Note that since the pressure is uniform throughout the cold finger chamber 45 the displacers 50 can be moved with relatively little energy expended. This displaces the high pressure working fluid from the warm end chamber section 54 through the channel 68, the inside of the regenerator chamber 73, and the passageway 70, to the cold end chamber section 52. In passing through the regenerator chamber 73, whose regenerator material 72 has been cooled during previous cycles, the working fluid cools. Since the pressure is maintained constant by the high pressure source 67 and the volume of the cold finger chamber 45 is fixed, further working fluid enters the cold finger chamber 45, in response to the cooling effect. With the displacer 50 at the top of the cold finger chamber 34, adjacent to the top of the warm end 38, the valve 65 closes to the high pressure source and opens to the low pressure source 69, releasing the pressure in the cold finger 34 through the passageway 64. Fluid escapes through the passageway 64 as the pressure level falls. The drop in pressure corresponds to an expansion of the working fluid, causing its temperature to fall throughout the cold finger. The working fluid in the cold end chamber section 52, having been already cooled by its passage through the regenerator chamber 73, is cooled even further. The decrease in temperature of the working fluid in the cold end chamber section 52 causes heat to be extracted from the cold end structure 36 to the working fluid. Thereby, heat is also extracted from any structure to which the cold end structure 36 is attached. This is the useful refrigeration step of the cycle. With the valve 65 still open to low pressure, the displacer 50 moves from the top to the bottom of the cold finger chamber 45, displacing working fluid from the cold end chamber section 52 through the passageway 70, the regenerator chamber 73, and the passageway 68, to the warm end chamber section 54. As the working fluid flows through the regenerator chamber 73 the fluid is heated by the thermally conducting material 72 in the generator chamber 73 to near ambient temperatures. This process cools the regenerator material 72 in preparation for the working fluid entering the system in the succeeding cycle. At this point, the cycle is repeated. Repeated operation of this cycle will drive the temperature of the cold end structure 36 down until the equilibrium of the system is reached. At the equilibrium point the refrigeration effect equals the thermal losses and the thermal capacity of the regenerator material 72 reaches its limit.

The details of the construction and operation of a cryocooler using the Gifford-McMahon cycle are well known to those skilled in the art of cryogenic refrigeration and are not repeated here. See, for example, the patents describing Gifford-McMahon cryocoolers and related designs as set forth above. It should be particularly noted that the present invention is not limited to cryocoolers operating on the Gifford-McMahon cycle using the design described above, but could be equally well applied to various Gifford-McMahon cycle designs, including those with a fixed regenerator in the cold finger chamber separate from the displacers and cryocoolers employing thermodynamic cycles to act on the working fluid other than the Gifford-McMahon cycle.

Figure 4:
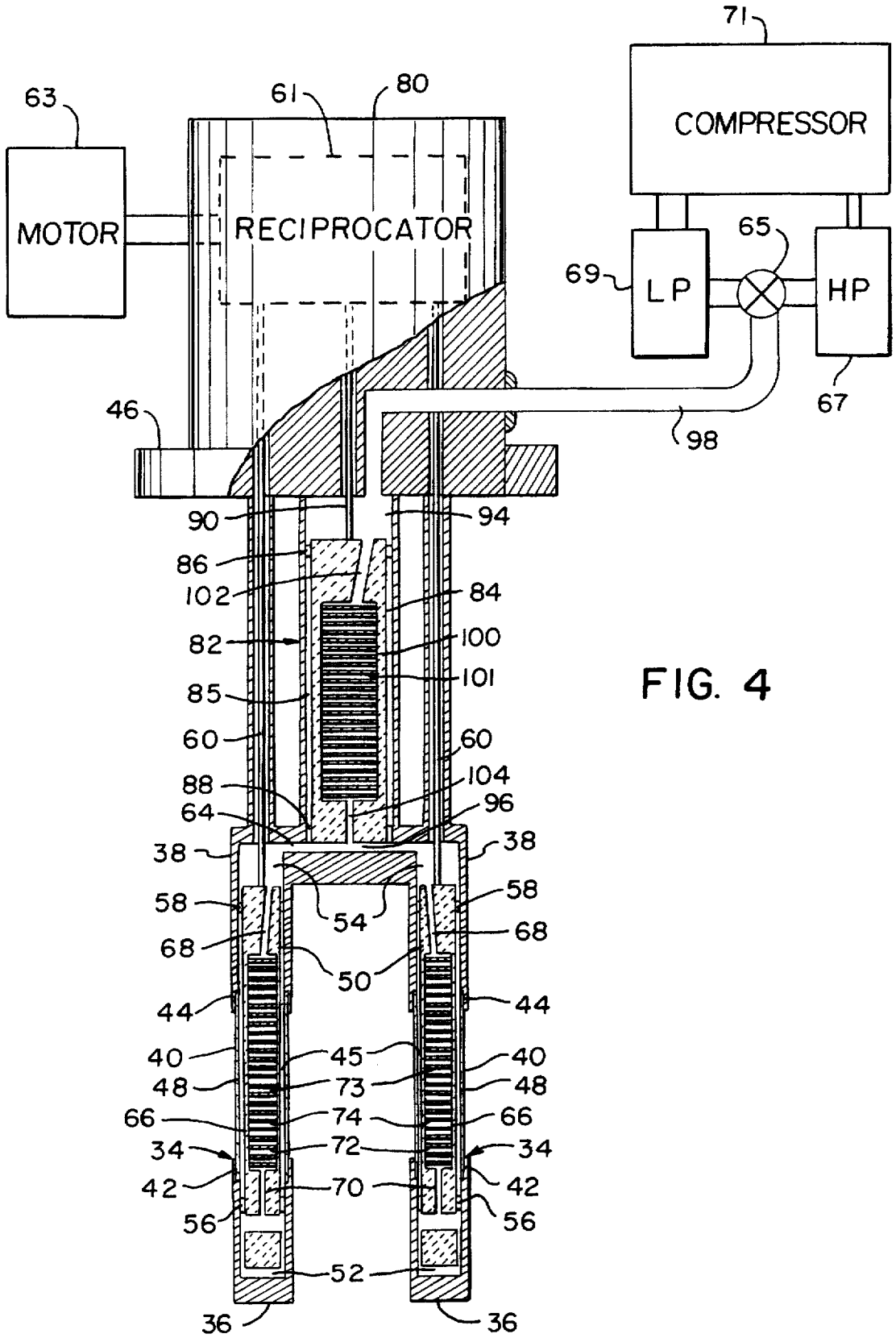
FIG. 4 is a simplified view in partial cross-section of a two stage, dual cold finger cryocooler in accordance with the present invention.

A multi-stage cryocooler 80 in accordance with the present invention is shown in partial cross-section in FIG. 4. Multi-stage cryocoolers are used to achieve lower cooling temperatures then are achievable from single stage cryocoolers. In the multi-stage cryocooler 80 shown in FIG. 4, the cold fingers 34 are constructed and operate in the same manner as the cold fingers of the single stage cryocooler shown in FIG. 2. Therefore, the numerical designations for the parts of the cryocooler shown in FIG. 2 are carried over to refer to the analogous parts of the cryocooler shown in the embodiment of FIG. 4.

In the multi-stage cryocooler 80, instead of connecting together at the pressure head 46, the cold fingers 34 are connected to a first stage 82 configured similarly to the cold fingers 34 which now form the second stage of the cryocooler 80. Unlike the cold fingers of the second stage, however, the enclosing walls of the first stage 82 may be made entirely of electrically conducting material, such as stainless steel, as electrical isolation of the first stage 82 from the cold end structures 36 of the cold fingers 34 is provided in the cold fingers 34.

The first stage displacer 84 is axially positioned inside of the first stage chamber 85 formed by the enclosing walls of the first stage 82. The displacer 84 is a loose fit in the first stage chamber 85 except at its ends where it is equipped with dynamic (sliding) seals 86 and 88 to prevent leakage of working fluid between the displacer 84 and the enclosing wall of the first stage 82. A first stage drive rod 90 is connected through the pressure head 46 to the reciprocator mechanism 61. The drive rod 90 is slidingly sealed where it passes through the pressure head 46. The piston rods 60 attached to the cold finger displacers 50 may be connected to the same reciprocator mechanism 61 as the first stage piston rod 90 so as to synchronize the reciprocation of all of the displacers in the system. The first stage displacer 84 defines a cold end chamber section 96 and a warm end chamber section 94 in the first stage chamber 85. The warm end chamber section 94 is fluidly connected through a passage 98 in the pressure head 46 to the valve 65 and the sources of high pressure 67 and low pressure 69 working fluid. The cold end chamber section 96 of the first stage 82 is fluidly connected via the passageways 64 to the warm end chamber sections 54 of the cold fingers 34. The first stage displacer 84 contains a regenerator 100. The outer wall of the displacer 84 forms an enclosure, the regenerator chamber 101, which is packed with a heat absorbing regenerator material which allows working fluid entering the regenerator through the passageway 102 in the first stage displacer 84 to pass through the regenerator chamber 101, over the regenerator material, and out of the displacer 84 through the passageway 104. The regenerator material in the first stage regenerator chamber 101 and the regenerator material 72 in the cold finger regenerator chambers 73 may have different specific heat characteristics. This will allow each stage of the cryocooler 80 to operate efficiently at different ambient temperatures, the second (cold finger) stage 34 being colder than the first stage 82. For example, lead balls packed between the separator screens 74 in the cold finger regenerators may be preferably used for the second stage regenerator material 72 due to the high heat capacity of lead in the 15 K to 50 K range.

The multi-stage cryocooler operates by acting on the working fluid in essentially the same manner as a single stage cryocooler. With the displacers 84 and 50 at their lowest points, near the bottom of the chambers 96 and 52, the valve 65 is opened to the high pressure source 67 to admit pressurized working fluid through the passage 98 into the cryocooler 80. This increases the pressure level throughout the cryocooler. Fluid fills the warm end chamber of the first stage 94, flows through the passage 102 to fill the first stage regenerator chamber 101, flows out of the passage 104 through the passages 64 to fill the warm end chambers 54 of the cold fingers 34, and through the passageways 68 to fill the cold finger regenerator chambers 73. With the high pressure maintained the displacers 84 and 50 are moved by operation of the reciprocator 61 and piston rods 90 and 60 from the bottom of the first stage 82 and the cold finger 34, to the top of the first stage 82 and the cold finger 34, respectively. Fluid is thereby displaced from the warm chamber 94 of the first stage 82 through the generator chamber 101 to the cold chamber 96 of the first stage 82, and from the warm chamber 54 of the cold finger 34 through the cold finger regenerator chamber 73 to the cold end chamber 52 of the cold finger 34. In passing through the regenerator chambers 101 and 73 the working fluid cools, causing the pressure to decrease and further working fluid to enter through the passage 98 and through the system to the cold finger chambers 45 to maintain the maximum cycle pressure. Fluid which enters the cold end chamber section 52 of the cold finger chambers 45 is colder than the fluid in the cold end chamber section 96 of the first stage 82 since it has been further cooled in its passage through the cold finger regenerator chamber 73. With the displacers 50 and 84 near the top of their respective stages the valve 65 is closed to the high pressure source 67 and the passage 98 is opened to the low pressure source 69. The working fluid escapes from the cryocooler 80 as the pressure falls. The drop in pressure corresponds to an expansion of the working fluid throughout the cryocooler, causing its temperature to fall. As with the single stage cryocooler, a decrease in temperature of the working fluid in the cold end chamber section 52 of the cold finger 34 causes heat to be extracted from the cold end structure 36 and any structure to which it is connected. Note that the temperature at the cold end 36 of the cold finger 34 will be colder than that at the cold end of the first stage 82 in that the fluid in the cold end chamber 52 of the cold finger 34 was initially colder than the fluid in the cold end chamber section 96 of the first stage prior to the temperature drop resulting from the expansion of the working fluid. With the exhaust valve still open, i.e. the valve 65 open to low pressure, the displacers 84 and 50 are once again moved to the bottom of the first stage 82 and the cold fingers 34, displacing fluid from the chambers 96 and 52 to the chambers 94 and 54, respectively. As the fluid flows through the regenerator chambers 101 and 73 the fluid is heated by the regenerator material and the regenerator material is cooled in preparation for the next cycle. Once again, the cycle is repeated, driving the temperature of the cold end structures 36 down to the point where system equilibrium is reached. Note that the ambient temperature of the first stage 82 will be higher than the ambient temperature of the cold fingers 34.

It should be noted that a multi-stage cryocooler in accordance with the present invention is not limited to the embodiment shown in FIG. 4. For example, more than one preliminary stage may be employed. Also, each cold finger may be composed of more than one stage, with the voltage isolation structure of the present invention incorporated in at least one of the stages of the multi-stage cold finger. Additionally, a multi-stage cryocooler with only a single cold finger having the requisite insulting structures may be in accordance with the present invention. The thermodynamic cycle employed to act on the working fluid in a multi-stage cryocooler in accordance with the present invention need not be the Gifford-McMahon cycle. Additionally, different stages of the cryocooler may employ different thermodynamic refrigeration cycles to act on the working fluid. (See, e.g., U.S. Pat. No. 3,902,328.) Also, the voltage isolation structure of the present invention may be applied to multi-stage cryocoolers wherein the regenerators are in fixed positions in the working fluid chambers, and not enclosed inside the moving displacers. (See, e.g., U.S. Pat. No. 5,113,663.) In such a case, an insulating structure would have to be used for both the regenerator enclosure and the displacer structures which are connected to the cold end of the cryocooler. The details of the construction and operation of multi-stage cryocoolers, using various thermodynamic cycles to act on the working fluid, are well known to those skilled in the art of cryogenic refrigeration.

Figure 5:
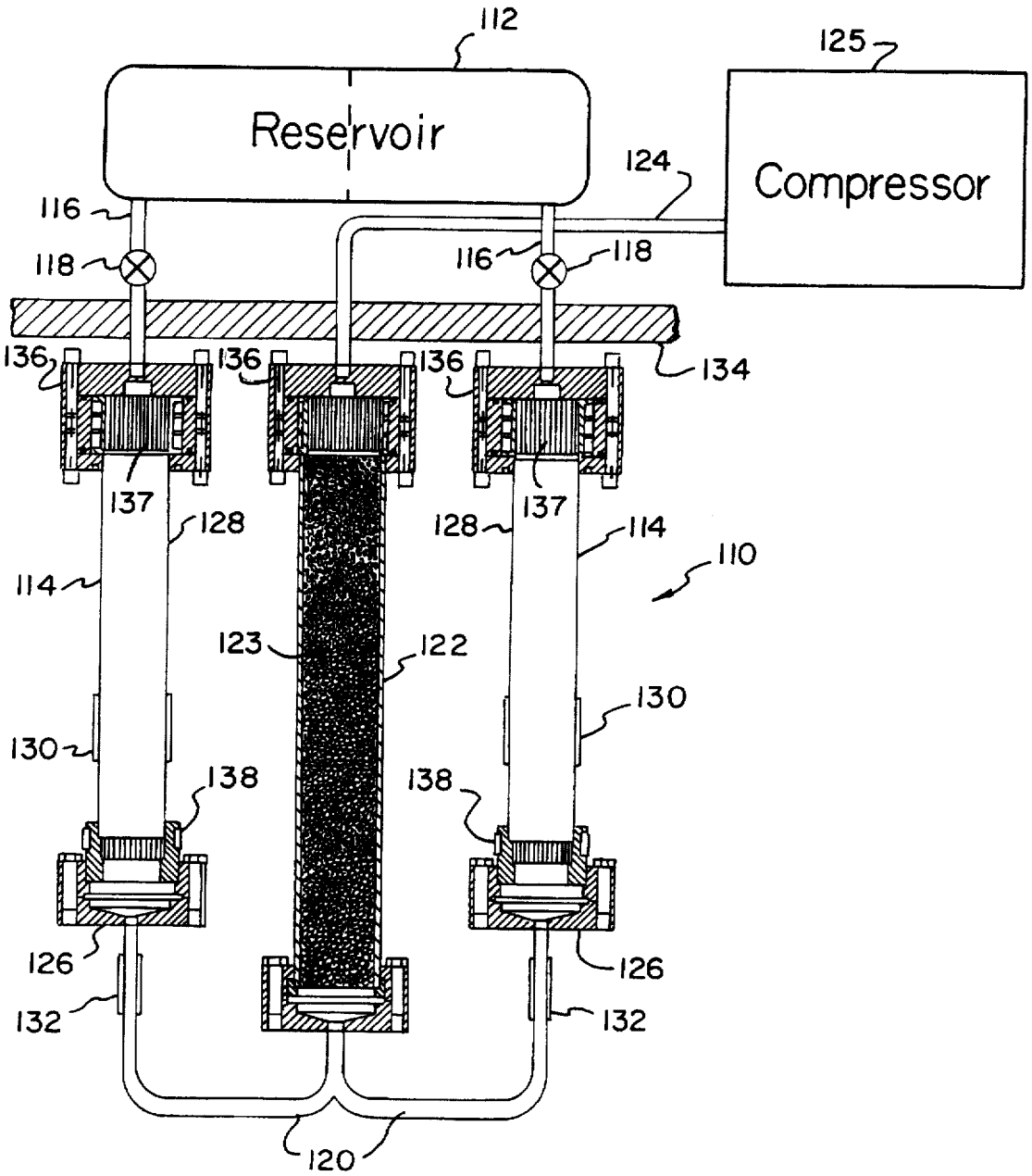
FIG. 5 is a schematic cross-sectional view of a dual cold finger orifice pulse-tube type cryocooler in accordance with the present invention.

For purposes of further exemplification, a cryocooler in accordance with the present invention employing an orifice pulse-tube type thermodynamic cycle to act on the working fluid is described with reference to the schematic diagram of FIG. 5. As with the embodiments discussed above, the details of the construction and operation of pulse tube cryocoolers are well known to those skilled in the art of cryogenic refrigeration. Exemplary pulse tube cryocooler designs, which may incorporate the voltage isolation characteristics of the present invention, are shown, e.g., in U.S. Pat. Nos. 3,237,421, 3,314,244, 3,431,746, 3,817,044, 4,953,366, 5,269,147, 5,275,002, 5,295,355, 5,303,555, and 5,335,505, the disclosures of which are incorporated herein by reference. The pulse-tube cryocooler, shown generally at 110, is a dual cold finger cryocooler, with each pulse tube 114 acting as a separate cold finger. Single cold finger pulse-tube cryocoolers, having a single pulse tube and incorporating the requisite electrically insulating structure, may also be made in accordance with the present invention.

The dual cold finger orifice pulse-tube cryocooler 110 includes a single regenerator 122 and two pulse-tubes 114. The cold end 126 of each pulse-tube 114 is connected by a pipe 120 to a cold end of the regenerator 122. The warm end of the regenerator 122 is connected by a pipe 124 to a compressor 125. The interior of the regenerator 122 is packed with a regenerating material 123, e.g., in the form of a screen matrix, which allows the passage of a cryogenic working fluid, such as helium, through the interior of the regenerator 122. The warm end 128 of the pulse tube 114 is connected through a pipe 116 to a working fluid reservoir 112. For the dual cold finger cryocooler 110, each pulse tube 114 may be connected to a separate reservoir or to the single reservoir 112 as shown. Orifice valves 118 are provided along the pipe 116 to control the flow of working fluid into the pulse tube 114. The pipes 116 and 124 connect to the pulse tube 114 and regenerator 122 through the wall 134 of a vacuum chamber. The vacuum chamber wall 134 may, for example, be the top wall 24 of a cryogenically cooled device 10 as shown in FIG. 1. Heat exchangers 136 are provided at the warm end 128 of each pulse tube 114 and at the warm end of the regenerator 122. During operation, water may be pumped through passages which are in intimate thermal contact with copper screens 137 in the interior of the warm end heat exchangers 136 to draw heat (e.g., heat of compression) from the warm ends of the pulse tube 114 and regenerator 122. Heat exchangers 138 may also be provided as part of the cold end structure 126 of the pulse tube 114. The cold end heat exchangers 138 are preferably designed to provide a smooth (laminar) flow of working fluid into and out of the cold end 126 of the pulse tube 114.

One mechanism which transfers heat from the cold end 126 to the warm end 128 of the pulse tube 114 involves a heat pumping mechanism in which the crucial factor is the heat transfer between the working fluid gas in the pulse tube 114 and the wall of the pulse tube. The compressor 125 exerts an oscillating pressure on the working fluid gas confined in the pulse tube 114. As the gas expands during a low pressure pulse from the compressor 125, it moves toward the cold end 126 of the tube 114. As the gas expands it becomes colder than the adjacent wall and, therefore, absorbs some heat from the wall. During the compression portion of the cycle, the gas moves toward the warm end 128 of the tube 14. As the gas is compressed, it also heats up. The gas, therefore, becomes warmer than the adjacent wall and, therefore, deposits heat to the wall. The warm end heat exchangers 136 remove the heat of compression from the warm end 128 of the pulse tube 114. The cooling and heating effects taking place at opposite ends of the pulse tube 114 result in a significant temperature gradient in the tube where heat is being pumped from the cold end 126 to the warm end 128 of the tube 114. This heat pumping mechanism is the only heat transfer mechanism for simple pulse tube type refrigerators. This mechanism is also present in the orifice pulse tube 110, but is much less effective than the primary heat transfer mechanism in that arrangement.

In orifice pulse tube cryocoolers, refrigeration capacity is increased by providing a difference in phase between the pressure fluctuation in the pulse tube 114 and the physical displacement of the working fluid gas in the pulse tube 114. The primary mechanism for removing heat from the cold end 126 of an orifice pulse-tube cryocooler 110, therefore, involves an enthalpy flow in the working fluid gas, resulting from an optimized phase relation between the temperature oscillation and the mass flow oscillation in the pulse tube 114. The phase optimization is achieved via the valve 118 and the reservoir 112 on the warm end 128 of the pulse tube 114. When the valve 118 is at the optimum opening, the mass flow oscillations and the gas temperature oscillations have the best relative phase between themselves to result in a net flow of heat from the cold end 126 to the warm end 128 of the pulse tube 114. This is termed an "enthalpy flow" because it is the product of the mass flow, and the specific enthalpy ($h=C_pT$, where $C_p$ is the specific heat) which defines the enthalpy of the working fluid gas.

In accordance with the present invention the dual cold finger pulse-tube cryocooler 110 may be used to cool two structures charged to differing voltage levels by electrically isolating the warm end 128 of the pulse tube 114 from the cold end structure 126 of the pulse tube 114, which is thermally and electrically connected to the electrically charged structure to be cooled, and by electrically isolating the cold end structure 126 of the pulse tube 114 from the regenerator 122. This electrical isolation is accomplished by replacing a portion of the pulse tube 114 enclosure wall with an insulating structure 130 and replacing a portion of the pipe 120 connecting the pulse tube 114 to the regenerator 122 by an electrically insulating pipe portion 132. The inner diameter of the insulating enclosure wall 130 of the pulse tube 114 preferably exactly follows the remainder of the pulse tube 114. The inner diameter of the pulse tube 114 may be constant or tapered, but it is important that there not be a difference in the inside wall geometry as a result of adding the insulating piece 130. This will prevent turbulence in the working fluid flow which could adversely affect the refrigeration effect of heat transfer between the working fluid and the pulse tube wall. The insulating pieces 130 and 132 are preferably located close to the cold end structures 126 to minimize the amount of cold end structure which is electrically charged. Locating the insulating piece 130 of the pulse tube wall approximately 1½ inches from the cold end structure 126 is preferred. The material used for the insulating wall 130 and insulating pipe 132 must be sufficiently thick and formed of an appropriate material to withstand the pressure differential between the inside of the pulse tube 114 and connecting pipe 120 and the vacuum pressure level outside of these tubes. Also, the length of the insulating sections 130 and 132 must be sufficiently long to insure that the local electric field in the working fluid is maintained below the breakdown voltage of the working fluid. This will prevent a breakdown in electrical isolation due to arching across the working fluid. The lengths of the insulating sections 130 and 132 may be determined using Paschen's curve for the gas of interest. As described above, a safety factor of 2.5 times the desired voltage isolation level is preferably used in determining the insulation required. The insulating pulse tube walls 130 should also be of a material which minimizes thermal conduction through the walls 130 between the warm end 128 and the cold end 126 of the pulse tube 114. A ceramic material is preferably used for the insulating sections 130 and 132. For example, low purity alumina ceramic ($Al_2O_3$) with silicon impurities may be used. If a material such as G-10 epoxy fiberglass is used for the insulating sections 130 and 132, a stainless steel sleeve may be placed on the inside of the insulating sections 130 and 132 to help prevent the diffusion of the working fluid through the wall. However, if such a diffusion barrier is employed, it must be positioned such that electrical isolation between the cold end 126 and warm end 128 of the pulse tube 114 is maintained.

It is understood that the present invention is not limited to the particular embodiments set forth herein as illustrative, but embraces all such modified forms thereof as come within the scope of the following claims.

What is claimed is:

1. A cryogenic cooling apparatus, comprising:

a cold finger having a cold end structure made of a thermally and electrically conductive material to be placed in metallic contact with an electrically charged structure to be cooled, a warm end structure, and an enclosing wall made of an electrically insulating material connected between the cold end structure and the warm end structure, the cold end structure, warm end structure, and enclosing wall, forming a cold finger chamber for containing a cryogenic working fluid;

a regenerator in the cold finger chamber, the regenerator having an electrically insulating enclosure forming a regenerator chamber, the regenerator chamber being in fluid communication with the cold finger chamber and containing a porous regenerator material interleaved with a sufficient number of electrically insulating separator screens to divide the regenerator chamber into sub-chambers which permit fluid flow in the regenerator chamber and which create small voltage steps across the working fluid when the cold end structure is attached to the electrically charged structure such that the local electric field inside the cold finder does not exceed the breakdown voltage of the working fluid; and means for acting on the cryogenic working fluid in the cold finger chamber in a thermodynamic cycle to cool the cold end structure to a cryogenic temperature level.

2. The cryogenic cooling apparatus of claim 1 wherein the electrically insulating enclosing wall is made of ceramic material.

3. The cryogenic cooling apparatus of claim 1 wherein the electrically insulating separator screens are made of a material selected from the group of electrically insulating materials consisting of polytetrafluoroethylene, nylon, and epoxy fiberglass.

4. The cryogenic cooling apparatus of claim 1 additionally comprising a displacer axially enclosed within the cold finger chamber in a manner whereby the displacer may be moved in reciprocating fashion axially within the cold finger chamber and wherein a portion of an outer wall of the displacer is made of electrically insulating material which forms a portion of the regenerator enclosure such that the regenerator is enclosed in the displacer, and means for reciprocating the displacer within the cold finger chamber.

5. The cryogenic cooling apparatus of claim 4 additionally comprising means for admitting low pressure and high pressure working fluid into the cold finger chamber and wherein the thermodynamic cycle for cooling the cold end structure is the Gifford-McMahon cycle.

6. The cryogenic cooling apparatus of claim 1 wherein the warm end structure of the cold finger is attached to a previous stage cold end of a previous stage of the cryogenic cooling apparatus such that working fluid may flow from the previous stage into the cold finger chamber, and wherein the previous stage comprises means for cooling the working fluid before being admitted to the cold finger chamber.

7. A multiple cold finger cryogenic cooling apparatus, comprising:

two cold fingers, each cold finger having a cold end structure made of a thermally and electrically conductive material wherein each cold end structure is to be placed in metallic contact with a separate structure to be cooled, a warm end structure, and an enclosing wall made of an electrically insulating material connected between the cold end structure and the warm end structure, the cold end structures, warm end structures, and enclosing walls forming a cold finger chamber for containing a cryogenic working fluid in each cold finger, the two cold fingers connected together at the warm end of each cold finger, the cold end structures of each cold finger electrically isolated from each other and from the warm end structures by the electrically insulating enclosing walls; and means for acting on the cryogenic working fluid in the cold finger chambers in a thermodynamic cycle to cool the cold end structures of each cold finger to approximately the same cryogenic temperature level.

8. The multiple cold finger cryogenic cooling apparatus of claim 7 wherein the electrically insulating enclosing walls are made of ceramic material.

9. The multiple cold finger cryogenic cooling apparatus of claim 7 additionally comprising a regenerator in each cold finger chamber, each regenerator having an electrically insulating enclosure forming a regenerator chamber, each regenerator chamber being in fluid communication with one of the cold finger chambers and containing a porous regenerating material interleaved with a sufficient number of electrically insulating separator screens to divide the regenerator chamber into sub-chambers which permit fluid flow in the regenerator chamber and which create small voltage steps across the working fluid when the cold end structures are attached to electrically charged structures such that the local electric field inside the cold finger does not exceed the breakdown voltage of the working fluid.

10. The multiple cold finger cryogenic cooling apparatus of claim 9 wherein the electrically insulating separator screens are made of a material selected from the group of electrically insulating materials consisting of polytetrafluoroethylene, nylon, and epoxy fiberglass.

11. The multiple cold finger cryogenic cooling apparatus of claim 9 additionally comprising a displacer axially enclosed within each cold finger chamber in a manner whereby each displacer may be moved in reciprocating fashion axially within one of the cold finger chambers and wherein a portion of an outer wall of each displacer forms a portion of the enclosure of one of the regenerators such that each regenerator is enclosed in one displacer, and means for reciprocating the displacers within the cold finger chambers.

12. The multiple cold finger cryogenic cooling apparatus of claim 11 additionally comprising means for admitting high pressure and low pressure working fluid into the cold finger chambers and wherein the thermodynamic cycle for cooling the cold end structures is the Gifford-McMahon cycle.

13. The multiple cold finger cryogenic cooling apparatus of claim 7 wherein the warm end structures of the cold fingers are attached together to a previous stage cold end of a previous stage of the cryogenic cooling apparatus such that working fluid may flow from the previous stage into the cold finger chambers, and wherein the previous stage comprises means for cooling the working fluid before being admitted to the cold finger chambers.

14. A multiple cold finger cryogenic cooling apparatus, comprising:

(a) two cold fingers, each cold finger having a cold end structure made of a thermally and electrically conductive material wherein each cold end structure is to be placed in metallic contact with a separate structure to be cooled, a warm end structure, and an enclosing wall made of an electrically insulating material connected between the cold end structure and the warm end structure, the cold end structures, warm end structures, and enclosing walls forming a cold finger chamber in each cold finger, the two cold fingers connected together at the warm end of each cold finger, the cold end structures of each cold finger electrically isolated from each other and from the warm end structures by the electrically insulating enclosing walls;

(b) a regenerator in each working fluid chamber, each regenerator having an enclosure forming a regenerator chamber, each regenerator chamber being in fluid communication with one of the cold finger chambers and containing a porous regenerating material interleaved with a sufficient number of electrically insulating separator screens to divide the regenerator chamber into sub-chambers which permit fluid flow in the regenerator chamber and which create small voltage steps across the working fluid when the cold end structures are attached to electrically charged structures such that the local electric field inside the cold finger does not exceed the breakdown voltage of the working fluid;

(c) a displacer axially enclosed within each cold finger chamber in a manner whereby each displacer may be moved in reciprocating fashion axially within one of the cold finger chambers and wherein a portion of an outer wall of each displacer forms a portion of the enclosure of one of the regenerators such that each regenerator is enclosed in one displacer;

(d) means for reciprocating the displacers within the cold finger chambers; and (e) means for admitting high pressure and low pressure working fluid into the cold finger chambers to cool the cold end structures of each cold finger to approximately the same cryogenic temperature level by means of the Gifford-McMahon thermodynamic cycle.

15. The multiple cold finger cryogenic cooling apparatus of claim 14 wherein the electrically insulating enclosing wall is made of ceramic material.

16. The multiple cold finger cryogenic cooling apparatus of claim 14 wherein the electrically insulating separator screens are made of a material selected from the group of electrically insulating materials consisting of polytetrafluoroethylene, nylon, and epoxy fiberglass.

17. The multiple cold finger cryogenic cooling apparatus of claim 14 wherein the warm end structures of the cold fingers are attached to a previous stage cold end of a previous stage of the cryogenic cooling apparatus such that working fluid may flow from the previous stage into the cold finger chambers, and wherein the previous stage comprises means for cooling the working fluid before being admitted to the cold finger chambers.

18. The multiple cold finger cryogenic cooling apparatus of claim 17 wherein the previous stage of the cryogenic cooler cools the working fluid by means of Gifford-McMahon thermodynamic cycle, and additionally comprises:

(a) a previous stage outer wall enclosing a previous stage working fluid chamber;

(b) a previous stage displacer axially enclosed within the previous stage working fluid chamber in a manner whereby the displacer may be moved axially in reciprocating fashion within the previous stage working fluid chamber;

(c) means for reciprocating the previous stage displacer in the previous stage working fluid chamber; and (d) a previous stage regenerator chamber enclosed in the previous stage displacer and in fluid communication with the previous stage working fluid chamber, the previous stage regenerator chamber containing regenerator material which permits fluid flow in the previous stage regenerator chamber.

19. The multiple cold finger cryogenic cooling apparatus of claim 18 wherein the regenerator material in the cold finger regenerator chambers has a larger heat capacity for temperatures ranges below 50 K than the regenerator material in the previous stage regenerator chamber.

20. A multiple cold finger pulse-tube cryogenic cooling apparatus, comprising:

(a) two pulse-tubes, each pulse-tube having a cold end structure made of a thermally and electrically conductive material wherein each cold end structure is to be placed in metallic contact with a separate structure to be cooled, a warm end structure including a warm end heat exchanger, and an enclosing wall a portion of which is made of an electrically insulating material connected between the cold end structure and the warm end structure, the cold end structures, warm end structures, and enclosing walls forming a working fluid chamber in each pulse-tube;

(b) orifice connections between a reservoir and the warm end structures of the pulse-tubes which allow a mass flow between the reservoir and the working fluid chambers to produce an optimum phase between a working fluid pressure and an oscillation of the mass flow;

(c) a regenerator tube having a cold end and a warm end including a warm end heat exchanger and enclosing a regenerator chamber, the regenerator chamber containing regenerator material which permits fluid flow in the regenerator chamber;

(d) connection pipes connecting the cold end-structures of the pulse-tubes and the cold end of the regenerator tube such that the working fluid chambers and the regenerator chamber are in fluid communication and wherein at least a part of each connection pipe is made of an electrically insulating material such that the cold end structures of the pulse-tubes are electrically isolated from each other, from the warm end structures of the pulse-tubes and from the regenerator tube by the electrically insulating portions of the enclosing walls and connection pipes; and (e) means connected to the warm end of the regenerator tube for applying high and low pressure pulses to the working fluid in the working fluid chambers to cool the cold end structures of each pulse tube to approximately the same cryogenic level by means of a pulse-tube thermodynamic cycle.

21. The multiple cold finger pulse-tube cryogenic cooling apparatus of claim 20 wherein at least one of the electrically insulating enclosing walls or the electrically insulating parts of the connection pipes are made of ceramic material.

22. A superconductive energy storage device, comprising:

(a) a device enclosure;

(b) a coil made of superconductive material within the enclosure;

(c) means for cooling the superconductive coil within the enclosure to a cryogenic temperature level;

(d) electrical leads connected to the superconductive coil and extending through the enclosure; and (e) a cryogenic cooling apparatus having at least one cold finger having a cold end structure made of a thermally and electrically conductive material placed in electrical and thermal contact with at least one of the electrical leads within the enclosure, a warm end structure, and an enclosing wall made of an electrically insulating material connected between the cold end structure and the warm end structure, the cold end structure, warm end structure, and enclosing wall, forming a cold finger chamber for containing a cryogenic working fluid; and means for acting on a cryogenic working fluid in the cold finger chamber in a thermodynamic cycle to cool the cold end structure to a cryogenic temperature level.

23. The superconductive energy storage device of claim 22 wherein the electrically insulating enclosing wall is made of ceramic material.

24. The superconductive energy storage device of claim 22 wherein the cold finger is a pulse-tube and the thermodynamic cycle for cooling the cold end structure is a pulse-tube cycle.

25. The superconductive energy storage device of claim 22 additionally comprising a regenerator in the cold finger chamber, the regenerator having an electrically insulating enclosure forming a regenerator chamber, the regenerator chamber being in fluid communication with the cold finger chamber and containing a porous regenerating material interleaved with a sufficient number of electrically insulating separator screens to divide the regenerator chamber into sub-chambers which permit fluid flow in the regenerator chamber and which create small voltage steps across the working fluid when the cold end is attached to an electrically charged structure such that the local electric field in the cold finger does not exceed the breakdown voltage of the working fluid.

26. The superconductive energy storage device of claim 25 wherein the electrically insulating separator screens are made of a material selected from the group of electrically insulating materials consisting of polytetrafluoroethylene, nylon and epoxy fiberglass.

27. The superconductive energy storage device of claim 25 additionally comprising a displacer axially enclosed within the cold finger chamber in a manner whereby the displacer may be moved in reciprocating fashion axially within the cold finger chamber and wherein a portion of an outer wall of the displacer is electrically insulating and forms a portion of the regenerator enclosure such that the regenerator is enclosed in the displacers, and means for reciprocating the displacer within the cold finger chamber.

28. The superconductive energy storage device of claim 27 additionally comprising means for admitting low and high pressure working fluid into the cold finger chamber and wherein the thermodynamic cycle for cooling the cold end structure is the Gifford-McMahon cycle.

29. The superconductive energy storage device of claim 28 wherein the warm end structure of the cold finger is attached to a previous stage cold end of a previous stage of the cryogenic cooling apparatus such that working fluid may flow from the previous stage into the cold finger chamber, and wherein the previous stage comprises means for cooling the working fluid before being admitted to the cold finger chamber.

30. A cold finger for a cryogenic cooling apparatus, comprising:

(a) a cold end structure made of a thermally and electrically conductive material;

(b) a warm end structure;

(c) an enclosing wall made of an electrically insulating material, the cold end structure, warm end structure, and enclosing wall forming a cold finger chamber for containing a cryogenic working fluid;

(d) a porous regenerator material in the cold finger chamber which permits fluid flow in the cold finger chamber; and (e) a sufficient number of separator screens made of electrically insulating material in the cold finger chamber and interleaved with the regenerator material to divide the cold finger chamber into sub-chambers which permit fluid flow in the cold finger chamber and which create small voltage steps across the working fluid in the cold finger chamber when the cold end structure is connected to an electrically charged structure such that the local electric field in the cold finger does not exceed the breakdown voltage of the working fluid.

31. The cold finger of claim 30 wherein the electrically insulating enclosing wall is made of ceramic material.

32. The cold finger of claim 30 wherein the electrically insulating separator screens are made of a material selected from the group of electrically insulating materials consisting of polytetrafluoroethylene, nylon, and epoxy fiberglass.

33. A regenerator for a cryogenic cooling apparatus, comprising:

(a) an enclosing structure made of an electrically insulating material, enclosing a regenerator chamber and having means for permitting flow of a cryogenic working fluid into the regenerator chamber;

(b) porous regenerating material in the regenerator chamber which permits fluid flow in the regenerator chamber; and (c) a sufficient number of separator screens made of electrically insulating material in the regenerator chamber and interleaved with the regenerator material to separate the regenerator chamber into sub-chambers which permit fluid flow through the regenerator chamber and which create small voltage steps across the working fluid in the regenerator chamber when an electric potential is applied across the regenerator chamber such that the local electric field in the regenerator does not exceed the breakdown voltage of the working fluid.

34. The regenerator of claim 33 wherein the electrically insulating enclosing structure is made of ceramic.

35. The regenerator of claim 33 wherein the electrically insulating separator screens are made of a material selected from the group of electrically insulating materials consisting of polytetrafluoroethylene, nylon, and epoxy fiberglass.

36. A method for cryogenically cooling an electrically charged structure, comprising the steps of:

(a) attaching an electrically and thermally conductive cold end structure of a cold finger of a cryogenic cooler to the electrically charged structure to be cooled;

(b) electrically isolating the cold end structure from a warm end structure of the cold finger;

(c) drawing heat from the cold end structure by acting on a cryogenic working fluid in a working fluid chamber in the cold finger in a thermodynamic cycle to cool the cold end structure and the electrically charged structure.

37. The method of claim 36 wherein the thermodynamic cycle to cool the cold end structure is a pulse-tube cycle.

38. The method of claim 36 including the additional step of dividing a voltage drop across the working fluid chamber from the cold end structure to the warm end structure into voltage drop steps each of which is less than a breakdown voltage of the working fluid.

39. The method of claim 38 wherein the thermodynamic cycle to cool the cold end structure is a Gifford-McMahon cycle including the steps of (a) admitting the working fluid under high pressure into the working fluid chamber through the warm end structure of the cold finger;

(b) cooling a portion of the working fluid by passing the working fluid through a regenerator;

(c) lowering the pressure in the cold finger chamber to cause expansion and cooling of the working fluid throughout the chamber; and (d) warming a portion of the working fluid by passing the working fluid through the regenerator.

40. The method of claim 39 wherein the steps of cooling a portion of the working fluid and warming a portion of the working fluid include the step of moving the regenerator through the cold finger chamber.

41. A method for cryogenically cooling two electrically charged structures which are at different electric potentials, comprising the steps of:

(a) providing a cryogenic cooler with two cold fingers each having a warm end structure and an electrically and thermally conducting cold end structure, attaching the electrically and thermally conductive cold end structure of each cold finger to one of the electrically charged structures to be cooled;

(b) electrically isolating the cold end structure of each cold finger from the other;

(c) drawing heat from the cold end structure of each cold finger by acting on a cryogenic working fluid in a working fluid chamber in each cold finger in a thermodynamic cycle to cool the cold end structures of each cold finger and the electrically charged structures to approximately the same temperature.

42. The method of claim 41 including the additional step of dividing a voltage drop across the working fluid chamber in each cold finger from the cold end structure to the warm end structure into voltage drop steps each of which is less than a breakdown voltage of the working fluid.

43. The method of claim 41 wherein the thermodynamic cycle to cool the cold end structure of each cold finger is a Gifford-McMahon cycle including the steps of (a) admitting the working fluid under high pressure into the working fluid chamber through the warm end structure of the cold finger;

(b) cooling a portion of the working fluid by passing the working fluid through a regenerator;

(c) lowering the pressure in the cold finger chamber to cause expansion and cooling of the working fluid throughout the chamber; and (d) warming a portion of the working fluid by passing the working fluid through the regenerator.

44. The method of claim 43 wherein the steps of cooling a portion of the working fluid and warming a portion of the working fluid include the step of moving the regenerator through the cold finger chamber.

45. A multiple cold finger cryogenic cooling apparatus, comprising:

(a) two or more cold fingers, each cold finger having a cold end structure made of a thermally and electrically conductive material wherein each cold end structure is to be placed in contact with a separate structure to be cooled, a warm end structure, and enclosing walls forming a cold finger chamber for containing a cryogenic working fluid in each cold finger, the two cold fingers connected together at the warm end of each cold finger;

(b) means for electrically isolating the cold ends of the two cold fingers from each other;

(c) a regenerator in each cold finger chamber, each regenerator having an enclosure forming a regenerator chamber, each regenerator chamber being in fluid communication with one of the cold finger chambers and containing a porous regenerating material interleaved with separator screens to divide the regenerator chamber into sub-chambers, which permit fluid flow in the regenerator chamber;

(d) means for acting on the cryogenic working fluid in the cold finger chambers in a Gifford-McMahon thermodynamic cycle to cool the cold end structures of each cold finger to approximately the same cryogenic temperature level, including a displacer axially enclosed within each cold finger chamber in a manner whereby each displacer may be moved in reciprocating fashion axially within one of the cold finger chambers and wherein a portion of an outer wall of each displacer forms a portion of the enclosure of one of the regenerators such that each regenerator is enclosed in one displacer, and means for reciprocating the displacers within the cold finger chambers; and (e) means for admitting high pressure and low pressure working fluid into the cold finger chambers.

46. The multiple cold finger cryogenic cooling apparatus of claim 45 wherein each regenerator has an electrically insulating enclosure forming the regenerator chamber, and wherein the separator screens are formed of an electrically insulating material which create small voltage steps across the working fluid when the cold end structures are attached to electrically charged structures such that the local electric field in the cold finger does not exceed the breakdown voltage of the working fluid.

47. The multiple cold finger cryogenic cooling apparatus of claim 46 wherein the electrically insulating separator screens are made of a material selected from the group of electrically insulating materials consisting of polytetrafluoroethylene, nylon, and epoxy fiberglass.

48. The multiple cold finger cryogenic cooling apparatus of claim 45 wherein the warm end structures of the cold fingers are attached together to a previous stage cold end of a previous stage of the cryogenic cooling apparatus such that working fluid may flow from the previous stage into the cold finger chambers, and wherein the previous stage comprises means for cooling the working fluid before being admitted to the cold finger chambers.

49. The multiple cold finger cryogenic cooling apparatus of claim 48 wherein the previous stage of the cryogenic cooler cools the working fluid by means of Gifford-McMahon thermodynamic cycle, and additionally comprises:

(a) a previous stage outer wall enclosing a previous stage working fluid chamber;

(b) a previous stage displacer axially enclosed within the previous stage working fluid chamber in a manner whereby the displacer may be moved axially in reciprocating fashion within the previous stage working fluid chamber;

(c) means for reciprocating the previous stage displacer in the previous stage working fluid chamber; and (d) a previous stage regenerator chamber enclosed in the previous stage displacer and in fluid communication with the previous stage working fluid chamber, the previous stage regenerator chamber containing regenerator material which permits fluid flow in the previous stage regenerator chamber.

50. The multiple cold finger cryogenic cooling apparatus of claim 49 wherein the regenerator material in the cold finger regenerator chambers has a larger heat capacity for temperatures ranges below 50 K than the regenerator material in the previous stage regenerator chamber.

* * * * *